US005891839A

United States Patent [19]

Erilli et al.

[11] Patent Number: 5,891,839

[45] Date of Patent: Apr. 6, 1999

[54] LIGHT DUTY LIQUID MICROEMULSION CLEANING COMPOSITIONS CONTAINING AN ALKYL SULFOESTER

[75] Inventors: Rita Erilli, Liege; Chantal Gallant, Cheratte, both of Belgium

[73] Assignee: Colgate Palmolive Company, Piscataway, N.J.

[21] Appl. No.: 859,431

[22] Filed: May 20, 1997

Related U.S. Application Data

[63] Continuation-in-part of Ser. No. 696,666, Aug. 14, 1996, abandoned.

[51] Int. Cl.[6] ..... C11D 17/00

[52] U.S. Cl. ..... 510/426; 510/428; 510/427; 510/432; 510/525; 510/424

[58] Field of Search ..... 510/424, 426, 510/428, 218, 235, 427, 429, 432, 525

[56] References Cited

U.S. PATENT DOCUMENTS

| | | | |
|---|---|---|---|
| 4,556,509 | 12/1985 | Demangeon et al. | 510/365 |
| 5,731,281 | 3/1998 | Mondin et al. | 510/417 |

*Primary Examiner*—Paul Lieberman
*Assistant Examiner*—Nicholas Ogden
*Attorney, Agent, or Firm*—Richard E. Nanfeldt; James M. Serafino

[57] ABSTRACT

A light duty liquid detergent with desirable cleansing properties and mildness to the human skin comprising: a sulfonate surfactant, an alkali metal or ammonium salt of a $C_{8-18}$ ethoxylated alkyl ether sulfate anionic surfactant, a sulfoacetate, sulfosuccinate or carboxylate surfactant, and water.

6 Claims, No Drawings

LIGHT DUTY LIQUID MICROEMULSION CLEANING COMPOSITIONS CONTAINING AN ALKYL SULFOESTER

RELATED APPLICATION

This application is a continuation in part application of U.S. Ser. No. 8/696,666 filed Aug. 14, 1996 now abandoned.

1. Field of Invention

This invention relates to a light duty liquid microemulsion cleaning composition which imparts enhanced mildness to the skin and is designed in particular for dishware and which is effective in removing grease soil and in leaving unrinsed surfaces with a shiny appearance.

2. Background of the Invention

In recent years all-purpose liquid detergents have become widely accepted for cleaning hard surfaces, e.g., painted woodwork and panels, tiled walls, wash bowls, bathtubs, linoleum or tile floors, washable wall paper, etc. Such all-purpose liquids comprise clear and opaque aqueous mixtures of water-soluble synthetic organic detergents and water-soluble detergent builder salts. In order to achieve comparable cleaning efficiency with granular or powdered all-purpose cleaning compositions, use of water-soluble inorganic phosphate builder salts was favored in the prior art all-purpose liquids. For example, such early phosphate-containing compositions are described in U.S. Pat. Nos. 2,560,839; 3,234,138; 3,350,319; and British Patent No.1, 223,739.

In view of the environmentalist's efforts to reduce phosphate levels in ground water, improved all-purpose liquids containing reduced concentrations of inorganic phosphate builder salts or non-phosphate builder salts have appeared. A particularly useful self-opacified liquid of the latter type is described in U.S. Pat. No. 4,244,840.

However, these prior art all-purpose liquid detergents containing detergent builder salts or other equivalent tend to leave films, spots or streaks on cleaned unrinsed surfaces, particularly shiny surfaces. Thus, such liquids require thorough rinsing of the cleaned surfaces which is a time-consuming chore for the user.

In order to overcome the foregoing disadvantage of the prior art all-purpose liquid, U.S. Pat. No. 4,017,409 teaches that a mixture of paraffin sulfonate and a reduced concentration of inorganic phosphate builder salt should be employed. However, such compositions are not completely acceptable from an environmental point of view based upon the phosphate content. On the other hand, another alternative to achieving phosphate-free all-purpose liquids has been to use a major proportion of a mixture of anionic and nonionic detergents with minor amounts of glycol ether solvent and organic amine as shown in U.S. Pat. No. 3,935,130. Again, this approach has not been completely satisfactory and the high levels of organic detergents necessary to achieve cleaning cause foaming which, in turn, leads to the need for thorough rinsing which has been found to be undesirable to today's consumers.

Another approach to formulating hard surface or all-purpose liquid detergent composition where product homogeneity and clarity are important considerations involves the formation of oil-in-water (o/w) microemulsions which contain one or more surface-active detergent compounds, a water-immiscible solvent (typically a hydrocarbon solvent), water and a "cosurfactant" compound which provides product stability. By definition, an o/w microemulsion is a spontaneously forming colloidal dispersion of "oil" phase particles having a particle size in the range of about 25 to about 800 Å in a continuous aqueous phase.

In view of the extremely fine particle size of the dispersed oil phase particles, microemulsions are transparent to light and are clear and usually highly stable against phase separation.

Patent disclosures relating to use of grease-removal solvents in o/w microemulsions include, for example, European Patent Applications EP 0137615 and EP 0137616—Herbots et al; European Patent Application EP 0160762—Johnston et al; and U.S. Pat. No. 4,561,991—Herbots et al. Each of these patent disclosures also teaches using at least 5% by weight of grease-removal solvent.

It also is known from British Patent Application GB 2144763A to Herbots et al, published Mar. 13, 1985, that magnesium salts enhance grease-removal performance of organic grease-removal solvents, such as the terpenes, in o/w microemulsion liquid detergent compositions. The compositions of this invention described by Herbots et al. require at least 5% of the mixture of grease-removal solvent and magnesium salt and preferably at least 5% of solvent (which may be a mixture of water-immiscible non-polar solvent with a sparingly soluble slightly polar solvent) and at least 0.1% magnesium salt.

However, since the amount of water immiscible and sparingly soluble components which can be present in an o/w microemulsion, with low total active ingredients without impairing the stability of the microemulsion is rather limited (for example, up to about 18% by weight of the aqueous phase), the presence of such high quantities of grease-removal solvent tend to reduce the total amount of greasy or oily soils which can be taken up by and into the microemulsion without causing phase separation.

The present invention relates to novel light duty liquid microemulsion compositions with high foaming properties, containing a sulfonate surfactant, a salt of an ethoxylated alkyl ether sulfate surfactant, a water insoluble hydrocarbon, cosurfactant, an alkyl sulfoacetate, alkyl carboxylate or dialkyl sulfosuccinate surfactant and water.

The prior art is replete with light duty liquid detergent compositions containing nonionic surfactants in combination with anionic and/or betaine surfactants wherein the nonionic detergent is not the major active surfactant, as shown in U.S. Pat. No. 3,658,985 wherein an anionic based shampoo contains a minor amount of a fatty acid alkanolamide. U.S. Pat. No. 3,769,398 discloses a betaine-based shampoo containing minor amounts of nonionic surfactants. This patent states that the low foaming properties of nonionic detergents renders its use in shampoo compositions non-preferred. U.S. Pat. No. 4,329,335 also discloses a shampoo containing a betaine surfactant as the major ingredient and minor amounts of a nonionic surfactant and of a fatty acid mono- or di-ethanolamide. U.S. Pat. No. 4,259,204 discloses a shampoo comprising 0.8–20% by weight of an anionic phosphoric acid ester and one additional surfactant which may be either anionic, amphoteric, or nonionic. U.S. Pat. No. 4,329,334 discloses an anionic-amphoteric based shampoo containing a major amount of anionic surfactant and lesser amounts of a betaine and nonionic surfactants.

U.S. Pat. No. 3,935,129 discloses a liquid cleaning composition based on the alkali metal silicate content and containing five basic ingredients, namely, urea, glycerin, triethanolamine, an anionic detergent and a nonionic detergent. The silicate content determines the amount of anionic and/or nonionic detergent in the liquid cleaning composition. However, the foaming property of these detergent compositions is not discussed therein.

U.S. Pat. No. 4,129,515 discloses a heavy duty liquid detergent for laundering fabrics comprising a mixture of substantially equal amounts of anionic and nonionic surfactants, alkanolamines and magnesium salts, and, optionally, zwitterionic surfactants as suds modifiers.

U.S. Pat. No. 4,224,195 discloses an aqueous detergent composition for laundering socks or stockings comprising a specific group of nonionic detergents, namely, an ethylene oxide of a secondary alcohol, a specific group of anionic detergents, namely, a sulfuric ester salt of an ethylene oxide adduct of a secondary alcohol, and an amphoteric surfactant which may be a betaine, wherein either the anionic or nonionic surfactant may be the major ingredient.

The prior art also discloses detergent compositions containing all nonionic surfactants as shown in U.S. Pat. Nos. 4,154,706 and 4,329,336 wherein the shampoo compositions contain a plurality of particular nonionic surfactants in order to effect desirable foaming and detersive properties despite the fact that nonionic surfactants are usually deficient in such properties.

U.S. Pat. No. 4,013,787 discloses a piperazine based polymer in conditioning and shampoo compositions which may contain all nonionic surfactant or all anionic surfactant.

U.S. Pat. No. 4,671,895 teaches a liquid detergent composition containing an alcohol sulfate surfactant, a nonionic surfactant, a paraffin sulfonate surfactant, an alkyl ether sulfate surfactant and water.

U.S. Pat. No. 4,450,091 discloses high viscosity shampoo compositions containing a blend of an amphoteric betaine surfactant, a polyoxybutylene polyoxyethylene nonionic detergent, an anionic surfactant, a fatty acid alkanolamide and a polyoxyalkylene glycol fatty ester. But, none of the exemplified compositions contains an active ingredient mixture wherein the nonionic detergent is present in major proportion, probably due to the low foaming properties of the polyoxybutylene polyoxyethylene nonionic detergent.

U.S. Pat. No. 4,595,526 describes a composition comprising a nonionic surfactant, a betaine surfactant, an anionic surfactant and a $C_{12}$–$C_{14}$ fatty acid monoethanolamide foam stabilizer.

U.S. Pat. Nos. 4,675,422; 4,698,181; 4,724,174; 4,770,815 and 4,921,942 disclose alkyl succinamates but the compositions are non related to light duty liquid compositions.

However, none of the above-cited patents discloses a liquid composition containing a sulfonate surfactant, an alkali metal or ammonium salt of an ethoxylated alkyl ether sulfate surfactant, a cosurfactant, a water insoluble hydrocarbon, a surfactant selected from the group consisting of an alkyl sulfoacetate, a dialkyl sulfosuccinate or an alkyl ethoxylated carboxylate surfactant and water, wherein the composition does not contain any inorganic builder salt, organic builder salt, nonionic surfactant which is the condensation product of an organic aliphatic or alkyl aromatic hydrophobic compound and hydrophilic ethylene oxide groups, low molecular weight mono- or di-glucoside, abrasives, silicas, alkaline earth metal carbonates, alkyl glycine surfactant, cyclic imidinium surfactant, alkali metal carbonates or more than 3 wt. % of a fatty acid or its salt thereof.

SUMMARY OF THE INVENTION

It has now been found that a light duty liquid composition which has desirable cleaning properties together with enhanced mildness to the human skin.

An object of this invention is to provide a novel light duty liquid detergent composition containing a sulfonate surfactant, an alkali metal salt or ammonium salt of an ethoxylated alkyl ether sulfate surfactant, a cosurfactant, a water insoluble hydrocarbon and a surfactant selected from the group consisting of an alkyl sulfoacetate, a dialkyl sulfosuccinate or an alkyl ethoxylated carboxylate and water wherein the composition does not contain any silicas, abrasives, alkali metal carbonates, alkaline earth metal carbonates, detergent builder salts, alkyl glycine surfactant, cyclic imidinium surfactant, low molecular weight mono- or di-glucoside organoaluminum containing compounds, organo titanium containing compounds, triethylene tetramine hexaacetic acid, imidazolenes, or more than 3 wt. % of a fatty acid or salt thereof and more preferably not more than 0.5 wt. % of a nonionic surfactant which is an aliphatic ethoxylate or an ethylene oxide and/or propylene oxide condensates with an alkanol.

Another object of this invention is to provide a novel light duty liquid detergent with desirable high foaming and cleaning properties which is very mild to the human skin.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

DETAILED DESCRIPTION OF THE INVENTION

The light duty liquid microemulsion compositions of the instant invention comprise approximately by weight:

(a) 0.5% to 14% of an alkali metal salt or ammonium salt of a $C_{8-18}$ ethoxylated alkyl ether sulfate surfactant;

(b) 1% to 22% of an alkali metal salt of a sulfonate surfactant;

(c) 1% to 12% of a third surfactant which is selected from the group consisting of an alkyl sulfoacetate, an alkyl ethoxylated carboxylate and a dialkyl sulfosuccinate;

(d) 1% to 15% of a cosurfactant;

(e) 0.4% to 10% of a water insoluble hydrocarbon; and (f) the balance being water.

As used herein and in the appended claims the term "perfume" is used in its ordinary sense to refer to and include any non-water soluble fragrant substance or mixture of substances including natural (i.e., obtained by extraction of flower, herb, blossom or plant), artificial (i.e., mixture of natural oils or oil constituents) and synthetically produced substance) odoriferous substances. Typically, perfumes are complex mixtures of blends of various organic compounds such as alcohols, aldehydes, ethers, aromatic compounds and varying amounts of essential oils (e.g., terpenes) such as from 0% to 80%, usually from 10% to 70% by weight, the essential oils themselves being volatile odoriferous compounds and also serving to dissolve the other components of the perfume.

In the present invention the precise composition of the perfume is of no particular consequence to cleaning performance so long as it meets the criteria of water immiscibility and having a pleasing odor. Naturally, of course, especially for cleaning compositions intended for use in the home, the perfume, as well as all other ingredients, should be cosmetically acceptable, i.e., non-toxic, hypoallergenic, etc.. The instant compositions show a marked improvement in ecotoxocity as compared to existing commercial products.

The hydrocarbon such as a perfume is present in the dilute o/w microemulsion in an amount of from 0.4% to 10% by weight, preferably from 0.6% to 8.0% by weight. If the amount of hydrocarbon (perfume) is less than 0.4% by weight it becomes more difficult to form the o/w microemulsion. In the case of the liquid crystal one need at least 0.5 weight % of perfume, more preferably 1 weight %. If the hydrocarbon (perfume) is added in amounts more than 10% by weight, the cost is increased without any additional cleaning benefit and, in fact, with some diminishing of cleaning performance insofar as the total amount of greasy or oily soil which can be taken up in the oil phase of the microemulsion will decrease proportionately.

Furthermore, although superior grease removal performance will be achieved for perfume compositions not containing any terpene solvents, it is apparently difficult for perfumers to formulate sufficiently inexpensive perfume compositions for products of this type (i.e., very cost sensitive consumer-type products) which includes less than 20%, usually less than 30%, of such terpene solvents.

Thus, merely as a practical matter, based on economic consideration, the dilute o/w microemulsion detergent cleaning compositions of the present invention may often include as much as 0.2% to 7% by weight, based on the total composition, of terpene solvents introduced thereunto via the perfume component. However, even when the amount of terpene solvent in the cleaning formulation is less than 1.5% by weight, such as up to 0.6% by weight or 0.4% by weight or less, satisfactory grease removal and oil removal capacity is provided by the inventive diluted o/w microemulsions.

Thus, for a typical formulation of a diluted o/w microemulsion according to this invention a 20 milliliter sample of o/w microemulsion containing 1% by weight of perfume will be able to solubilize, for example, up to 2 to 3 ml of greasy and/or oily soil, while retaining its form as a microemulsion, regardless of whether the perfume contains 0%, 0.1%, 0.2%, 0.3%, 0.4%, 0.5%, 0.6%, 0.7% or 0.8% by weight of terpene solvent. In other words, it is an essential feature of the compositions of this invention that grease removal is a function of the result of the microemulsion, per se, and not of the presence or absence in the microemulsion of a "greasy soil removal" type of solvent.

In place of the perfume one can employ an essential oil or a water insoluble paraffin or isoparaffin having 6 to 18 carbon at a concentration of 0.4 to 10.0 wt. percent, more preferably 0.6 to 8.0 wt. %.

The $C_{8-18}$ ethoxylated alkyl ether sulfate surfactants used in the instant composition have the structure $$R—(OCHCH_2)_nOSO_3^{-M^+}$$

wherein n is about 1 to about 22 more preferably 1 to 3 and R is an alkyl group having about 8 to about 18 carbon atoms, more preferably 12 to 15 and natural cuts, for example, $C_{12-14}$ ; $C_{12-15}$ and M is an ammonium cation or an alkali metal cation, most preferably sodium or ammonium. The ethoxylated alkyl ether sulfate is present in the composition at a concentration of about 0.5 wt. % to about 14 wt. %, more preferably about 1 wt. % to 12 wt. %.

The ethoxylated alkyl ether sulfate may be made by sulfating the condensation product of ethylene oxide and $C_{8-10}$ alkanol, and neutralizing the resultant product. The ethoxylated alkyl ether sulfates differ from one another in the number of carbon atoms in the alcohols and in the number of moles of ethylene oxide reacted with one mole of such alcohol. Preferred ethoxylated alkyl ether polyethoxy sulfates contain 12 to 15 carbon atoms in the alcohols and in the alkyl groups thereof, e.g., sodium myristyl (3 EO) sulfate.

Ethoxylated $C_{8-18}$ alkylphenyl ether sulfates containing from 2 to 6 moles of ethylene oxide in the molecule are also suitable for use in the invention compositions. These detergents can be prepared by reacting an alkyl phenol with 2 to 6 moles of ethylene oxide and sulfating and neutralizing the resultant ethoxylated alkylphenol.

The linear alkyl benzene sulfonate contains from 10 to 16 carbon atoms in the alkyl group are used in the instant compositions wherein the alkyl benzene sulfonates has a high content of 3- (or higher) phenyl isomers and a correspondingly low content (well below 50%) of 2- (or lower) phenyl isomers, that is, wherein the benzene ring is preferably attached in large part at the 3 or higher (for example, 4, 5, 6 or 7) position of the alkyl group and the content of the isomers in which the benzene ring is attached in the 2 or 1 position.

The sulfonate surfactant is an alkali metal salt of a $C_{10}$–$C_{16}$ linear alkyl benzene sulfonate or $C_{10}$–$C_{16}$ paraffin sulfonate used at a concentration of about 1 wt. % to about 22 wt. %, more preferably about 2 wt. % to about 20 wt. % in the instant compositions.

The instant composition contains about 1 wt. % to about 12 wt. %, more preferably about 2 wt. % to about 10 wt. % of a third surfactant which is selected from the group consisting of dialkyl sulfosuccinates, alkyl sulfosuccinates, alkyl ethoxylated carboxylates and alkyl sulfo esters and mixtures thereof.

The dialkyl sulfosuccinate surfactant is depicted by the formula:

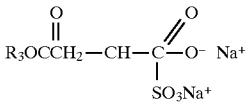

wherein $R_3$ is a $C_8$ to $C_{18}$ alkyl group, more preferably a $C_{10}$ to $C_{16}$ alkyl group. An especially preferred dialkyl sulfosuccinate surfactant is disodium $C_{12}$–$C_{14}$ alkyl sulfosuccinate.

The alkyl ethoxylated carboxylate surfactant is depicted by the formula

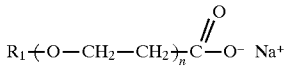

wherein $R_1$ is a $C_8$ to $C_{20}$, more preferably $C_{10}$ to $C_{16}$ alkyl group and n is from 10 to 16, more preferably 11 to 15. A preferred ethoxylated carboxylate surfactant is sodium laureth 13 carboxylate.

The alkyl sulfoester surfactant is depicted by the formula

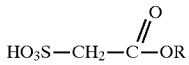

wherein R is a methyl, ethyl or propyl group, wherein sulfo acetate is prepared.

The cosurfactant may play an essential role in the formation of the microemulsion compositions. Highly suitable cosurfactants for the microemulsion over temperature ranges extending from 5° C. to 43° C. are water-soluble $C_3$–$C_4$ alkanols, polypropylene glycol of the formula $HO(CH_3CHCH_2O)_nH$ wherein n is a number from 2 to 18 and monoalkyl ethers and esters of ethylene glycol and propylene glycol having the structural formulas $R(X)_nOH$ and $R_1(X)_nOH$ wherein R is $C_1$–C6 alkyl, $R_1$ is $C_2$–$C_4$ acyl group, X is $(OCH_2CH_2)$ or $(OCH_2(CH_3)CH)$ and n is a number from 1 to 4.

Representative members of the polypropylene glycol include dipropylene glycol and polypropylene glycol having a molecular weight of 200 to 1000, e.g., polypropylene glycol 400. Other satisfactory glycol ethers are ethylene glycol monobutyl ether (butyl cellosolve), diethylene glycol monobutyl ether (butyl carbitol), triethylene glycol monobutyl ether, mono, di, tri propylene glycol monobutyl ether, tetraethylene glycol monobutyl ether, propylene glycol tertiary butyl ether, ethylene glycol monoacetate and dipropylene glycol propionate. When these glycol type cosurfactants are at a concentration of at least 1.0 weight %, more preferably at least 2.0 weight % in combination with a perfume at a concentration of at least 0.5 weight %, more preferably 1.5 weight % one can form a liquid crystal composition While all of the aforementioned glycol ether compounds and acid compounds provide the described stability, the most preferred cosurfactant compounds of each type, on the basis of cost and cosmetic appearance (particularly odor), are diethylene glycol monobutyl ether.

The amount of cosurfactant required to stabilize the microemulsion compositions will, of course, depend on such factors as the surface tension characteristics of the cosurfactant, the type and amounts of the primary surfactants and perfumes, and the type and amounts of any other additional ingredients which may be present in the composition and which have an influence on the thermodynamic factors enumerated above. Generally, amounts of cosurfactant in the range of from 1% to 15%, preferably from 2% to 12%, by weight provide stable dilute o/w microemulsions for the above-described levels of primary surfactants and perfume and any other additional ingredients as described below.

The instant compositions can contain about 0 wt. % to about 12 wt. %, more preferably about 0 wt. % to about 10 wt. %, more preferably 1 wt. % to 8.0 wt. % of at least one solubilizing agent which can be sodium xylene sulfonate, sodium cumene sulfonate, a $C_{2-3}$ mono or dihydroxy alkanols such as ethanol, isopropanol and propylene glycol and mixtures thereof. The solubilizing agents are included in order to control low temperature cloud clear properties.

The solubilizing ingredient can be a mixture of ethanol and a water soluble salt of a $C_1$–$C_3$ substituted benzene sulfonate hydrotrope such as sodium xylene sulfonate or sodium cumene sulfonate or a mixture of said sulfonates or ethanol and urea. Inorganic alkali metal or alkaline earth metal salts such as sodium sulfate, magnesium sulfate, sodium chloride and sodium citrate can be added at concentrations of 0.5 to 4.0 wt. % to modify the cloud point of the nonionic surfactant and thereby control the haze of the resultant solution. Various other ingredients such as urea at a concentration of about 0.5 to 4.0 wt. % or urea at the same concentration in combination with ethanol at a concentration of about 0.5 to 4.0 wt. % can be used as solubilizing agents.

The instant formulas explicitly exclude alkali metal silicates and alkali metal detergent builder salts such as alkali metal polyphosphates, alkali metal carbonates, alkali metal phosphonates and alkali metal citrates because these materials, if used in the instant composition, would cause the composition to have a high pH as well as leaving residue on the surface being cleaned. The final essential ingredient in the inventive compositions having improved interfacial tension properties is water.

In final form, the instant compositions exhibit stability at reduced and increased temperatures. More specifically, such compositions remain clear and stable in the range of 5° C. to 50° C., especially 10° C. to 43° C. The instant compositions have a light transmission of at least 95%. Such compositions exhibit a pH of 5 to 8. The liquid compositions are readily pourable and exhibit a viscosity in the range of 100 to 600 cps as measured at 25° C. with a Brookfield LVT Viscometer using a #2 spindle rotating at 30 RPM. Preferably, the viscosity is maintained in the range of 300 to 500 cps. The instant compositions have a minimum foam height of 110 mls after 55 rotation at 40° C. as measured by the foam volume test using 0.75 grams of the composition per liter of water and 1 gram of corn oil per liter of water having a hardness of 300 ppm.

The following examples illustrate liquid cleaning compositions of the described invention. Unless otherwise specified, all percentages are by weight. The exemplified compositions are illustrative only and do not limit the scope of the invention. Unless otherwise specified, the proportions in the examples and elsewhere in the specification are by weight.

EXAMPLE 1

The following composition in wt. % was prepared by simple mixing procedure at 25° C.:

| | A | B | C | D | E |
|---|---|---|---|---|---|
| Sodium paraffin sulfonate | 16 | 16 | 16 | 16 | 16 |
| AEOS (2 EO) | 10.3 | 10.3 | 10.3 | 10.3 | 10.3 |
| Dipropyleneglycol monomethyl ether | 6 | 6 | 6 | 6 | 6 |
| D-limonene | 6 | 6 | 6 | 6 | 6 |
| Sodium laureth 4 carboxylate | 7.6 | | | | |
| Sodium laureth 6 carboxylate | | 7.6 | | | |
| Sodium $C_{12-14}$ alkyl ether 7 carboxylate | | | 7.6 | | |
| Sodium laureth 11 carboxylate | | | | 7.6 | |
| Sodium laureth 13 carboxylate | | | | | 7.6 |
| Sodium $C_{13}$ alkyl ether carboxylate | | | | | |
| Sodium capryl ether carboxylate | | | | | |
| Disodium $C_{12-14}$ alkyl sulfosuccinate | | | | | |
| Disodium citric acid polyethoxy lauryl ether sulfosuccinate | | | | | |
| Ethanol | 1 | 1 | | | |
| Urea | 3 | 2 | | | |
| Perfume | 0.25 | 0.25 | 0.25 | 0.25 | 0.25 |
| Water | Bal. | Bal. | Bal. | Bal. | Bal. |
| Appearance RT | Clear | Clear | Clear | Clear | Clear |
| Miniplate | 37/39 | 35/40 | 39/36 | 36/36 | 39/33 |
| Oil uptake | 2.01 | 2.01 | 2.54 | 2.0 | 2.34 |

| | F | G | H | I |
|---|---|---|---|---|
| Sodium paraffin sulfonate | 16 | 16 | 16 | 16 |
| AEOS (2 EO) | 10.3 | 10.3 | 10.3 | 10.3 |
| Dipropylene glycol monomethyl ether | 6 | 6 | 6 | 6 |
| D-limonene | 6 | 6 | 6 | 6 |
| Sodium laureth 4 carboxylate | | | | |
| Sodium laureth 12 carboxylate | | | | |
| Sodium $C_{12-14}$ alkyl ether 7 carboxylate | | | | |
| Sodium laureth 11 carboxylate | | | | |
| Sodium laureth 13 carboxylate | | | | |
| Sodium $C_{13}$ alkyl ether carboxylate | 7.6 | | | |
| Sodium capryl ether carboxylate | | 7.6 | | |
| Disodiu $C_{12-14}$ alkyl sulfosuccinate | | | 7.6 | |
| Disodium citric acid polyethoxy lauryl ether sulfosuccinate | | | | 7.6 |
| Urea | 1.0 | | | 3.0 |
| ethanol | | | | |
| perfume | 0.25 | 0.25 | 0.25 | 0.25 |
| Water | Bal. | Bal. | Bal. | Bal. |
| Appearance RT | Clear | Clear | Clear | Clear |

-continued

| | | | | |
|---|---|---|---|---|
| Miniplate | 46/45 | 37/38 | 37/37 | 36/35 |
| Oil uptake | 1.56 | 2.39 | — | 0.55 |

1. Miniplate test

Miniplate test aims at assessing foam stability/duration of a dish liquid solution (1.25 g/l) in presence f a fat (Crisco Vegetable shortening from P&G). The higher the number the better the product.

What is claimed:

1. A clear light duty liquid cleaning composition which consist essentially of approximately by weight:

(a) 0.5% to 14% of an alkali metal or ammonium salt of a $C_{8-18}$ ethoxylated alkyl ether sulfate;

(b) 1% to 22% of a sulfactant selected from the group consisting of an alkali metal salt of a $C_{10}$–$C_{16}$ alkyl benzene sulfonate and an alkide metal salt of a $C_{10}$–$C_{16}$ paraffin sulfonate surfactant;

(c) 0.5 to 12% of at least one solubilizing agent;

(d) 1% to 12% of a third surfactant selected from the group consisting of alkyl sulfoesters, wherein the alkyl sulfoester has the formula

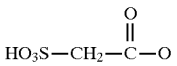

wherein R is a methyl, ethyl or propyl group.

(e) 1% to 15% of a glycol ether cosurfactant;

(f) 0 to 10% of a perfume, essential oil or water insoluble hydrocarbon; and (g) the balance being water, wherein the composition has a light transmission of at least 95% and does not contain more than 0.5 wt. % of a nonionic surfactant.

2. The composition of claim 1, wherein said solubilizing agent is a $C_{2-4}$ mono or dihydroxy alkanol.

3. The composition of claim 1, wherein said solubilizing agent is selected from the group consisting of isopropanol, ethanol and propylene glycol and mixtures thereof.

4. The composition of claim 1, wherein said solubilizing agent is sodium xylene sulfonate or sodium cumene sulfonate and urea.

5. The cleaning composition of claim 1 wherein the glycol ether is selected from the group consisting of ethylene glycol monobutyl ether, diethylene glycol monobutyl ether, triethylene glycol monobutyl ether, and propylene glycol ter-butyl ether, mono-, di-, tri- propylene monobutyl ether.

6. The cleaning composition of claim 1, wherein the glycol ether is selected from the group consisting of dipropylene glycol monobutyl ether, ethyleen glycol monobutyl ether and diethylene glycol monobutyl ether and mixtures thereof.

* * * * *